US007570179B2

(12) United States Patent
Chieu et al.

(10) Patent No.: US 7,570,179 B2
(45) Date of Patent: Aug. 4, 2009

(54) SYSTEM AND METHOD OF LOCATING VEHICLES WITH KEYLOCK SIGNALS

(75) Inventors: Trieu C. Chieu, Scarsdale, NY (US); David L. Cohn, Dobbs Ferry, NY (US); Shiwa S. Fu, Chappaqua, NY (US); Santhosh Kumaran, Peekskill, NY (US); Lawrence S. Mok, Brewster, NY (US)

(73) Assignee: International Business Machines Corporation, Armonk, NY (US)

( * ) Notice: Subject to any disclaimer, the term of this patent is extended or adjusted under 35 U.S.C. 154(b) by 335 days.

(21) Appl. No.: 11/620,180

(22) Filed: Jan. 5, 2007

(65) Prior Publication Data

US 2008/0165033 A1 Jul. 10, 2008

(51) Int. Cl.
*G08G 1/123* (2006.01)

(52) U.S. Cl. ..... 340/988

(58) Field of Classification Search ..... 340/988, 340/990, 425.5, 426.13, 995.28, 932.2; 701/113, 701/213

See application file for complete search history.

(56) References Cited

U.S. PATENT DOCUMENTS 6,909,964 B2 * 6/2005 Armstrong et al. ..... 701/207
2003/0197640 A9 * 10/2003 Johnson et al. ..... 342/357.07
2004/0098311 A1 5/2004 Nair et al. ..... 705/26
2004/0139449 A1 7/2004 Hope et al. ..... 719/318
2005/0027574 A1 2/2005 Agrawal et al. ..... 705/7
2005/0185046 A1 * 8/2005 Chen et al. ..... 348/14.13
2005/0228583 A1 * 10/2005 Capuano ..... 701/207
2006/0173587 A1 * 8/2006 Oesterling et al. ..... 701/2

* cited by examiner

*Primary Examiner*—Phung Nguyen
(74) *Attorney, Agent, or Firm*—Whitham, Curtis, Christofferson & Cook, PC; Stephen C. Kaufman

(57) ABSTRACT

A wireless key is signal, having a key-specific identifier, is received, the key-specific identifier detected, and the signal transmission location is calculated. The signal transmission location is stored based on the detected key-specific identifier. Another instance of the same wireless key signal is received, its key-specific identifier is detected, and the stored signal transmission location is retrieved based on the detected key-specific identifier. Optionally, a wireless key signal is received at a user and repeated at a plurality of locations in a parking facility. A vehicle response is detected, and associated with one of the repeatings of the wireless key signal. A location of the vehicle response is detected based on the repeating with which it is associated.

14 Claims, 5 Drawing Sheets

SYSTEM AND METHOD OF LOCATING VEHICLES WITH KEYLOCK SIGNALS

FIELD OF THE INVENTION

The field of the invention is object location, more specifically, locating a vehicle based on wireless keylock signals.

BACKGROUND OF THE INVENTION

Parking areas for facilities such as, for example, airports, super malls and train stations are often very large. Related problems include vehicle operators forgetting their vehicle's location in the parking lot. This problem can result in significant waste of effort and loss of time.

The related art has various methods for locating a vehicle in, for example, a parking area, but all of have various shortcomings.

One example is a Global Positioning System or equivalent satellite-based geolocation system (collectively "GPS") such as, for example, that described by U.S. Pat. No. 5,777,580, U.S. patent Publication No. 10051542, and Japan Patent No. 423091. GPS-based systems, however, may not function reliably indoors or in other locations without an unimpeded path radio transmission path to a sufficient number of GPS satellites. Further, GPS-based systems generally require an expense and overhead of a GPS receiver unit associated with the vehicle.

SUMMARY OF THE INVENTION

It is therefore an object of the invention to provide a method and system for identifying a location of a vehicle having a conventional wireless lock, and for providing that location to a user of the vehicle, without requiring any apparatus installed on the vehicle and without requiring any apparatus of the user other than the given vehicle's standard wireless key.

An aspect of one embodiment receives a vehicle-specific wireless key signal from the vehicle's given standard wireless key, when the key is used proximal to the vehicle, calculates the given key's location based on the received wireless key signal, and stores the calculated location to be retrievable based on subsequent reception of the same vehicle-specific wireless key signal. One embodiment retrieves and provides the location to a user in response to subsequently receiving the same vehicle-specific wireless keylock signal.

An aspect of one embodiment receives a vehicle-specific wireless keylock signal from a given vehicle's given key, at a user interface and repeats that vehicle-specific wireless keylock signal to cover a given area. One embodiment identifies a received signal as a vehicle keylock wireless acknowledgement signal correlated with the repeated vehicle-specific wireless key signal, and calculates a location of the transmission of the correlated signal. An aspect of one embodiment displays the calculated location at, for example, a user interface.

DETAILED DESCRIPTION OF PREFERRED EMBODIMENTS

Figure 1:
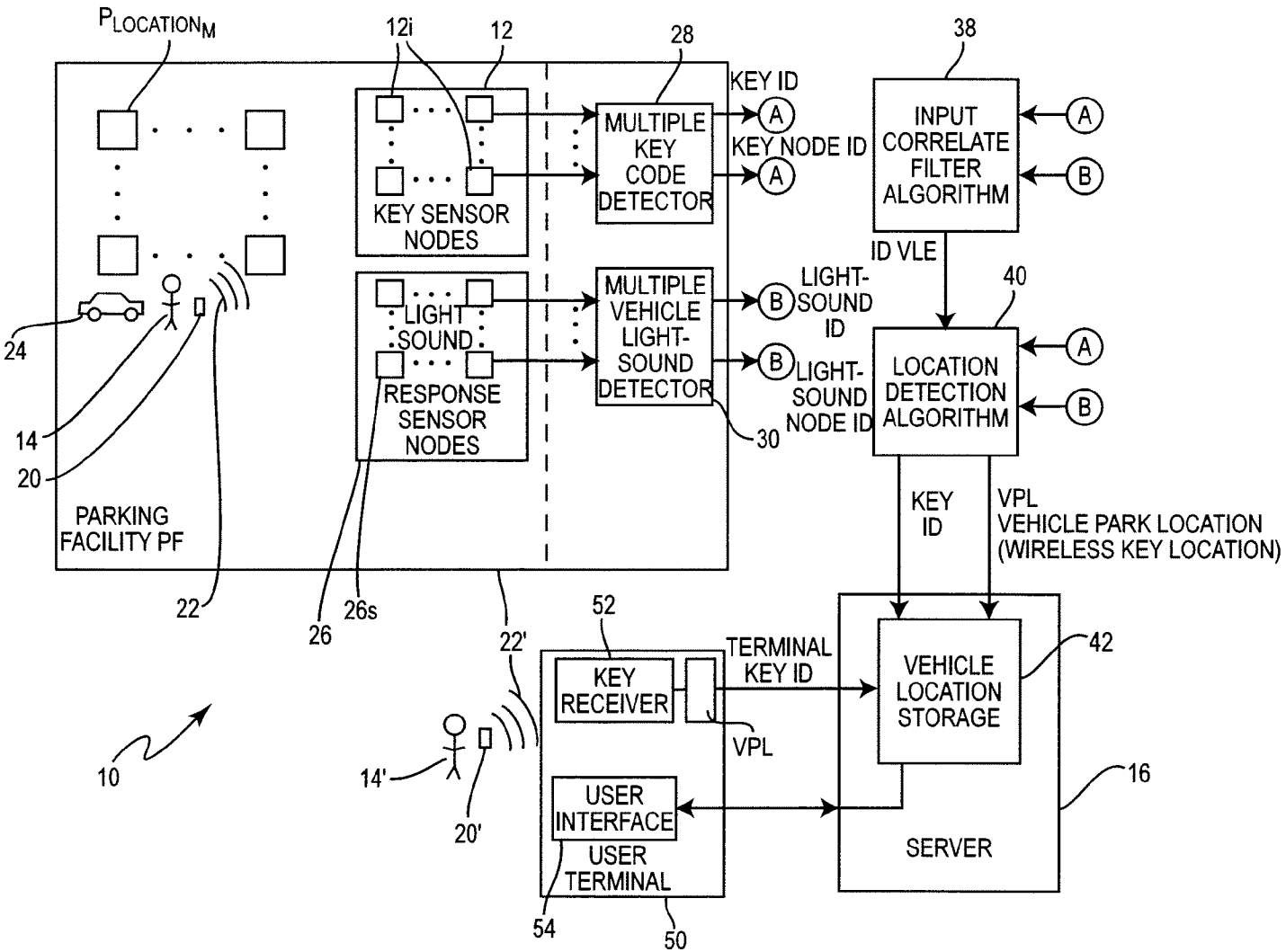
FIG. 1 illustrates an example architecture of a vehicle location system according to an embodiment that stores a vehicle location retrievable by a subsequent activation of a wireless key.

It is to be understood that the present invention is not limited to the specific examples described herein and/or depicted by the attached drawings, and that other configurations and arrangements embodying or practicing the present invention can, upon reading this description, be readily implemented by persons skilled in the arts pertaining to the invention.

In the drawings, like numerals appearing in different drawings, either of the same or different embodiments of the invention, reference functional or system blocks that are, or may be, identical or substantially identical between the different drawings.

It is to be understood that the various embodiments of the invention, although different, are not necessarily mutually exclusive. For example, a particular feature, function, aspect, act or characteristic described in one embodiment may, within the scope of the invention, be included in other embodiments.

Further, it is to be understood that unless otherwise stated or made clear from its context, the terminology and labeling used herein is not limiting and, instead, is only for purposes of internal labeling consistency.

Further, it is to be understood that functions, processes and operations shown or described as separate flow blocks are not, unless otherwise specified or clear from the context, limited to being performed at separate times, or by separate hardware, and that operations described or depicted as being separate may be implemented or represented as, for example, a single block.

Further, as will be understood by persons skilled in the art upon reading this description, certain well-known structures, algorithms, acts and operations are omitted, or are not described in detail, so as to better focus on, and avoid obscuring the novel features, combinations, and structures of the present invention.

General Overview

The present invention is described according to various functional units, blocks, processes, steps and/or operations (collectively "operations"). Unless otherwise stated or clear from the context, the operations may be embodied in machine-executable instructions, which may be stored on a machine-readable medium, which can be used to cause a programmable processor to perform the operations.

The term "the vehicle wireless lock" means a given vehicle's wireless lock, and all associated controller, radio signal receiver, and radio signal transmitter circuitry. The vehicle wireless lock may be a conventional wireless lock, not structurally or functionally specific to the instant invention, as installed by the vehicle manufacturer.

The terms "vehicle wireless key" and "wireless key" are interchangeable and mean a given vehicle's conventional wireless key corresponding to the vehicle lock, having a having a signal characteristic unique to the vehicle lock. The vehicle wireless key may be a conventional wireless key, such as provided by the vehicle manufacturer, not specific to the present invention.

The term "wireless key signal" means a signal transmitted by a vehicle key, having a characteristic unique to a specific vehicle wireless lock, for activating a response from the specific vehicle. Example responses from the specific vehicle include activating servo-motors in the vehicle for actuating the vehicle's door lock. The wireless key signal may be conventional, as specified by a vehicle manufacturer, without any format or other signal characteristic that is unique to the invention.

The term "vehicle lock response signal" and "lock response signal" are interchangeable and mean a signal transmitted from a vehicle wireless lock, having a characteristic unique to a specific vehicle, in response to receiving a wireless key signal having a characteristic unique to that specific vehicle.

The term "vehicle light-sound response(s)" collectively references all various light and acoustic responses, specified or implemented by automobile manufacturers, to be emanated from the vehicle when the vehicle is locked using the vehicle's conventional wireless key, or when the vehicle receives other wireless key signals from the vehicle's wireless key including, without limitation, horn beeps, and/or light pulses, flashes or other patterns such as, for example, specific sequences from headlights and/or parking, dome, or auxiliary lights. The terms "light" and "sound" are respectively defined as all forms and modes of light and sound that are or may be used, employed or implemented by vehicle manufacturers in association with vehicle wireless locks and are not limited, unless otherwise stated herein, to visible light or audible sound.

One embodiment is combined with vehicle wireless keys and vehicle wireless locks having extractable, time-static vehicle-specific characteristics of the wireless key signal. An aspect of one embodiment includes a network or array of wireless key signal receivers, each having a given coverage area. In one aspect, one or more of the wireless key signal receivers receives the given wireless key signal transmitted by, for example, the user manually actuating a pressure-sensitive feature of the wireless key, in a manner specified by the vehicle manufacturer, to lock the given vehicle.

An aspect of one embodiment detects the location from which the wireless key signal is first transmitted, i.e., the physical location of the user and the given wireless key, and generates a corresponding vehicle location data and vehicle-specific ID data, based on vehicle-specific characteristics of the given wireless key signal received by the wireless key signal receivers. One embodiment stores the key location data in a manner retrievable based on the key ID data.

An aspect of one embodiment receives, at a user location that may be remote from the vehicle location, a subsequent wireless key signal from the same given wireless vehicle key. An aspect extracts from the received subsequent wireless key signal another instance of the vehicle-specific ID data. One embodiment retrieves the vehicle location data from the location storage apparatus, based on the extracted another instance of the vehicle-specific ID data. The one embodiment may include presenting or communicating a human readable form of the retrieved vehicle location data to the user.

One embodiment may be combined, or used with vehicle wireless keys and vehicle wireless locks having instance-to-instance or time-dependent change, e.g., random hash type, of vehicle-specific characteristics of the wireless key signal and/or the wireless lock signal. An aspect provides a vehicle location, in response to a user transmitting a vehicle wireless key signal proximal to a user terminal, without requiring or having any prior stored location of the vehicle associated with that user's key.

An aspect of one embodiment receives, at a user interface that may be remote from the vehicle location, a wireless key signal, and repeats or rebroadcasts the received wireless key signal over a given area.

One embodiment receives a vehicle response signal subsequent to the repeating or rebroadcasting. An aspect of one embodiment measures a correlation or matching between the received vehicle response signal and the broadcast or repeated wireless key signal and, in response to a predetermined correlation or matching being measured, identifies the received vehicle response signal as corresponding to the wireless key signal.

One embodiment calculates a location area from which the corresponding received vehicle response signal was transmitted. An aspect of one embodiment may display or otherwise communicate a vehicle location to the user, based on the calculated location area.

One embodiment receives a vehicle audible-visible response subsequent to the repeating or rebroadcasting. An aspect of one embodiment measures a correlation or matching between the received vehicle audible-visible response and the broadcast or repeated wireless key signal and, in response to a predetermined correlation or matching being measured, identifies the received vehicle audible-visible response as corresponding to the wireless key signal.

One embodiment calculates an audible-visible emanation location area from which the corresponding received vehicle audible-visible response emanated. An aspect of one embodiment may display or otherwise communicate a vehicle location to the user, based on the calculated vehicle audible-visible response emanation location area.

An example architecture 10 is illustrated in FIG. 1, and includes a network or array of, for example, I wireless key signal receivers, which may be referenced collectively as, for example, key sensor nodes 12, which are labeled in FIG. 1 individually as key sensor node $\mathbf{12}_i$, i=1 to I. The FIG. 1 example key sensor nodes 12 are arranged to collectively cover a parking facility PF. An example parking facility PF may have, for example, M different parking locations, which are labeled in FIG. 1, for illustration only, as $\text{PLocation}_m$, m=1 to M.

It will be understood that the term "parking location" in this description means, without limitation, an area of, for example, one standard vehicle parking space, as well as an area or location from which, for example, four contiguous or adjacent ones of the facility's actual vehicle parking spaces may be visible.

Referring to FIG. 1, an example user, labeled as 14, is illustrated in the PF holding a given wireless key 20, which generates a wireless key 22 when activated by the use to lock the user's vehicle 24.

Preferably, the key sensor nodes 12 are spatially distributed such that each key sensor node $\mathbf{12}_i$ covers approximately one corresponding parking location $\text{PLocation}_m$. For purposes of this description the term "covers," with respect to a phrase such as "a sensor node $\mathbf{12}_i$ covers a parking location," means that a wireless key signal transmitted by, for example wireless key 20, within that parking location will, with a predetermined probability, be detected by the sensor node $\mathbf{12}_i$ as a valid signal.

An example distribution and spacing of the key sensor nodes 12 is, without limitation, a Cartesian arrangement, with adjacent key sensor nodes $\mathbf{12}_i$ being, for example, approximately three to approximately ten meters distant from one another. It will be understood that the actual distance is a design choice, dependent on, for example, a transmission power of the various wireless keys. It will also be understood that the key sensor nodes 12 may be arranged such that multiple nodes 12 cover a given parking location $PLocation_m$.

In an example implementation according to the FIG. 1 architecture 10, the key sensor nodes 12 may be connected to a server 16, either by individual link (not shown) or by, for example, a local router or other local server (not shown) local to the key sensor nodes 12.

Figure 2:
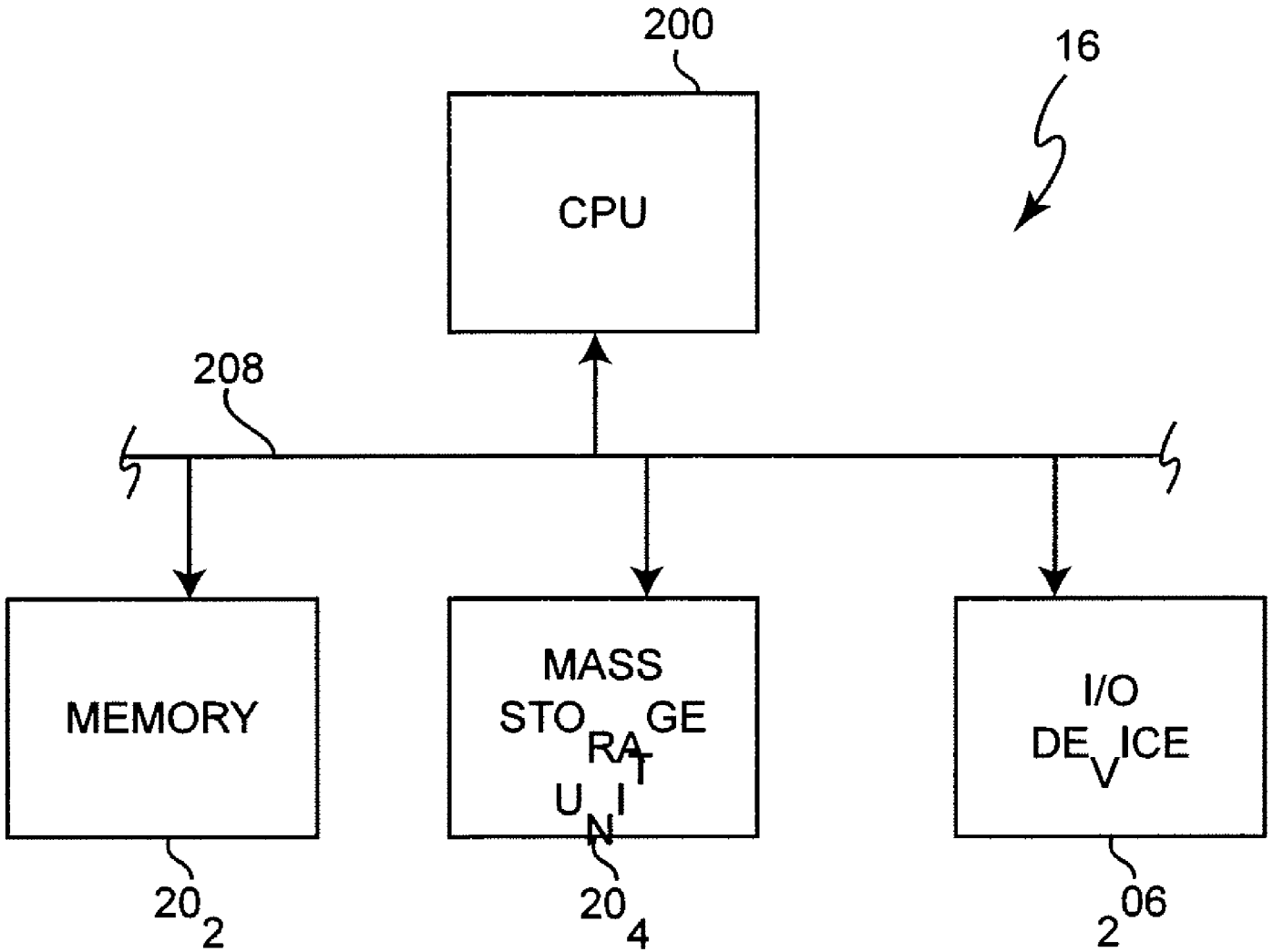
FIG. 2 illustrates an example architecture of a server of the described example embodiments.

Referring to FIG. 2, an example server 16 may include a programmable processing unit, or CPU, 200 having a memory 202, a disc drive or other read-write mass storage unit 204, an I/O device 206, and an internal bus 208.

Referring to FIG. 1, an example according to architecture 10 may include a multiple key code detector 28 associated with the key sensor nodes 12, constructed and arranged to detect various wireless key signals and to extract, or otherwise identify, vehicle-specific information from such signals. The multiple key code detector 28 may be constructed and arranged to detect various wireless key signals specified by various manufacturers by, for example carrier frequency(ies), bandwidth, modulation type, lock code technology, and lock codes. An example multiple key code sensor 28 may include components such as, for example, machine-readable code, and/or modules (not separately shown) provided by, for example, the various automobile manufacturers.

The FIG. 1 multiple key code detector 28 may be constructed and arranged such that its output is, for example, a tuple-type data that may be labeled, for example purposes, as Key ID, Key Node ID, where Key ID is a data identifying a specific wireless key, extracted from an identifier field (not specifically labeled) of the received wireless key signal, and Key Node ID is a data identify the key sensor node $12_i$ associated with the tuple such as, for example, the "i" index value.

With continuing reference to FIG. 1, it will be understood that the multiple key code sensor 28 is illustrated only as a functional block, and that its described or equivalent function may, for example, be implemented by various constructions and arrangements, either separate from or included in the individual key sensor nodes 12.

Referring to FIG. 1, an architecture according to 10 may include a plurality of, for example, S spatially separated light-sound response sensors 26, which may be referenced collectively as light-sound sensor nodes 26, and are labeled individually in FIG. 1 as light-sound response sensor nodes $26_s$, s=1 to S. It will be understood that implementations of the light-sound sensors 26 may include only sound or acoustic energy sensors, or only light sensors, or both.

As illustrated in FIG. 1, the light-sound sensor nodes 26 may be constructed and arranged to include, or have, an associated multiple vehicle sound detector 30. An example multiple vehicle light-sound detector 30 may be constructed and arranged to detect vehicle response light-sound patterns that characterize, or uniquely correspond to the light and/or sound patterns emanated by specific makes, models and, for example, years of automobiles in association with activation, operation, or communication to or from the vehicles' wireless lock. Example informational sources for constructing the multiple vehicle light-sound detector include actual sampling and measurement of various vehicles, using techniques well known to persons of ordinary skill in the relevant arts, and/or specifications provided by or obtainable from the various vehicle manufacturers.

Referring to FIG. 1, light-sound sensor nodes 26 may be constructed and arranged to output, for example, a tuple-type data, such as that labeled Light-Sound ID, Light-Sound Node ID, where Light-Sound ID may identify a specific vehicle response light and/or a specific vehicle response sound, and Light-Sound Node ID may identify the node(s) 26 that received the sound, the light, or both.

It will be understood that the FIG. 1 multiple vehicle light-sound detector 30 is an example of a functional aspect of architecture 10, and that the described detector function 30 or equivalent may be implemented in various hardware and software constructions and arrangements.

Referring to FIG. 1, an example of architecture according to 10 may include a correlating input filtering algorithm 38. An example correlating input filtering algorithm 38 correlates signal tuples, such as Key ID, Key Node ID, from the key sensor nodes 12 with light-sound tuples, such as Light-Sound ID, Light-Sound Node ID, from the light-sound nodes 26.

Referring to FIG. 1, the correlating input filtering algorithm 38 may be constructed and arranged to generate a data such as that labeled in FIG. 1 as VLE, indicating that different ones of the key nodes 12 and light-sound nodes 26 have detected correlated signals and/or sounds indicating the tuples as meeting a correlation criterion (not separately labeled). It will be understood that a correlating input algorithm such as 38 may reduce false data such as, for example, the user 14 parking and locking a vehicle 24 at a location in the facility PF and then, after walking to a location in the facility PF that is covered by a signal sensor node 12, but where his or her vehicle 14 is out of range of the wireless key 20, accidentally pressing and activating the key 20 again.

Various implementations and constructions of a multiple-sensor correlation algorithm 38 for false data filtering will be understood, and can be readily built and used for purposes of this invention, by persons skilled in the relevant art upon reading this description.

With continuing reference to FIG. 1, an architecture according to 10 may include a location detection algorithm 40 constructed and arranged to generate a vehicle parked location data, such as that labeled as VPL based on, for example, tuples Key ID, Key Node ID from the key sensor nodes 12 and Light-Sound ID, Light-Sound Node ID from the light-sound nodes 26.

With continuing reference to FIG. 1, algorithm 40 and a vehicle location storage 42 are constructed and arranged to store, in 42, the vehicle parked location data VPL. The vehicle location storage 42 may physically reside in, or be a virtual memory associated with, for example, the server 16. Preferably, a vehicle location storage 42 is constructed and arranged to store the vehicle parked location data VPL based on, i.e., to be retrievable by, the Key ID extracted by the FIG. 1 multiple key code sensor 28. As will be understood, storing VPL data as such provides for retrieving that VPL from the vehicle location storage 42 by using the same Key ID extracted from another instance of the same wireless key signal.

Referring to FIG. 1, an example according to architecture 10 may include a user terminal 50 having, for example, a wireless key signal receiver 52 and a user interface 54 that may include, for example, a display and/or a printer (not separately numbered). The example user terminal 50 may be connected to the server 16. The user terminal receiver 52 and user terminal interface 54 may be located at, for example, a kiosk (not shown) associated with the parking facility PF. A user 14' is depicted activating a wireless key 20' to generate a wireless key signal 22' in an area covered by the user terminal receiver.

With continuing reference to FIG. 1, a terminal multiple key code detector 56 is associated with, or included in, the receiver 52, and the code detector is preferably constructed and arranged to detect, for example, signals 22' that are all of the various kinds of wireless key signals 22 detectable by the multiple key code detector 28, and to extract or otherwise detect a Terminal Key ID signal from a vehicle-specific identification field (not shown) of such key signals 22'. Accordingly, a terminal key receiver 52 and terminal multiple key code detector 56 may be implemented by a device according to a key sensor node 12 and multiple key code detector 28.

Preferably, the FIG. 1 example terminal key signal receiver 52 and terminal multiple key code detector 56 are constructed and arranged such that, for a given specific wireless key 20' generating a signal 22' identical to 22, the Terminal Key ID extracted from the signal is the same as, or uniquely corresponds to, the Key ID extracted or detected from the wireless key signal 22 by the multiple key code sensor 28—assuming that the key-specific identifier code (not shown) of signal 22' is the same as the key-specific identifier code (not shown) of signal 22.

Referring to FIG. 1, the terminal multiple key code detector 56 may be constructed and arranged to communicate the Terminal Key ID to the vehicle location storage 42. The vehicle location storage 42 is constructed and arranged to retrieve the stored vehicle location data, labeled as VPL based on, or using, Terminal Key ID. As will be obvious to persons skilled in the relevant art upon reading this entire description, the VPL retrieved using Terminal Key ID of signal 22' is the VPL that was earlier stored in response to the user 14 locking his or her vehicle 24 in the parking facility PF.

As illustrated in, FIG. 1 an example architecture according to 10 may display VRL retrieved by the Terminal Key ID, i.e., the location where the user 14 previously used the given key 20 to park and lock his or her vehicle 24, in a human-readable form (not shown) at a display (not separately numbered) or printer (not separately numbered) of the user terminal interface 54. Various implementations of the FIG. 1 example user terminal interface 54 such as, without limitation, an interface to a user's personal digital assistant (PDA) (not shown), will be obvious to persons skilled in the relevant arts upon reading this entire disclosure.

Figure 3:
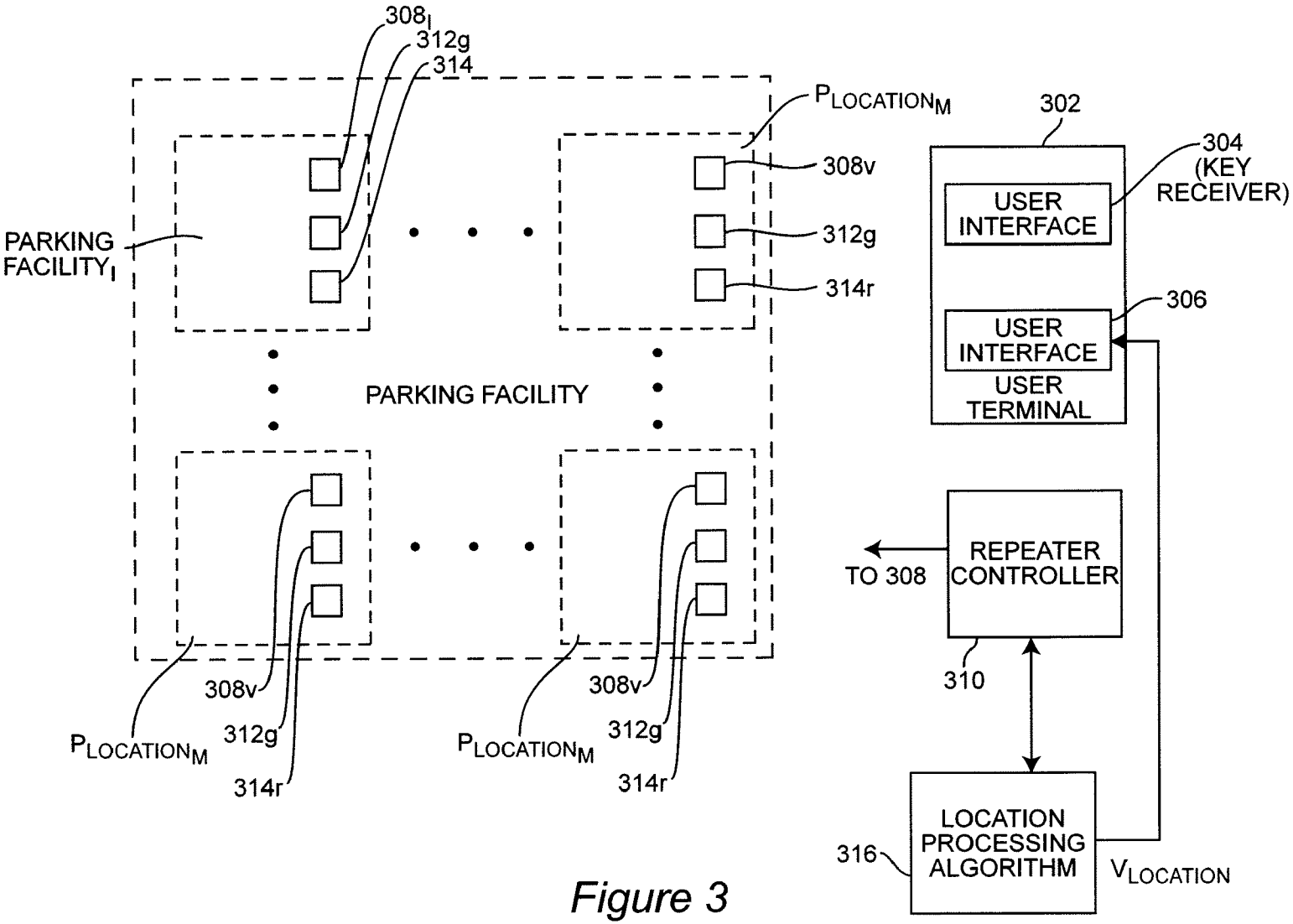
FIG. 3 illustrates an example architecture of a vehicle locating system according to one embodiment that provides a vehicle location by broadcasting a wireless key signal over an area and detecting a location of a vehicle response.

FIG. 3 shows an example architecture 300. Referring to FIG. 3, an architecture according to 300 may include a user terminal 302. An example user terminal 302 may include a wireless key receiver 304 and a user interface 306 such as, for example, a display, other graphical user interface or printer (not shown).

Referring to FIG. 3, an example according to an architecture 300 may include a network or array of, for example, V spatially separated repeaters, that may be referenced collectively as 308, and are labeled individually as $\mathbf{308}_v$, where v=1 to V. Preferably, the repeaters 308 are arranged with respect to a given parking facility PF having M different parking locations labeled, for example, as $\text{PLocation}_m$ m=1 to M, as described above in reference to FIG. 1.

An example implementation of the FIG. 3 repeaters 308 is for each repeater $\mathbf{308}_v$, to have a plurality or combination of key lock transmitters (not shown) from various manufacturers, such that each transmitter can reproduce an exact duplicate of the key lock signal captured at the wireless key signal receiver 304. As obvious to persons of ordinary skill in the relevant arts upon reading this entire disclosure, such repeaters 308 may be implemented with, for example, an off-the-shelf programmable transmitter, in accordance the knowledge of programmable transmitters that is known in the relevant arts, provided it is programmable to transmit various given kinds of wireless key signals.

With continuing reference to FIG. 3, preferably the repeaters 308 are arranged such that a specific one, or other small subset (such as two or three) of the repeaters 308 covers each parking location $\text{PLocation}_m$. As will be obvious to persons of ordinary skill in the relevant arts upon reading this description, the signal power transmitted by the repeaters 308 is preferably such that a vehicle more than approximately one parking location $\text{PLocation}_m$ away from an active repeater 308 will not receive sufficient signal strength to activate the vehicle's wireless lock. However, as also obvious to persons of ordinary in the relevant arts, upon reading this entire disclosure, the repeaters 308 may be arranged such that coverage overlaps occur.

Referring to FIG. 3, the example architecture 300 may include a repeater controller 310 constructed and arranged to control transmission by the repeaters 308 as described in further detail in the examples below. The repeater controller 310 may be implemented, for example, in the server 16 or in a server (not shown) local o the repeaters 308.

With continuing reference to FIG. 3, the example architecture 300 may include a network or array of, for example, Q spatially separated vehicle response signal sensor nodes, referenced collectively as 312, and labeled individually as, for example, $\mathbf{312}_q$, q=1 to Q. Preferably the vehicle response signal sensor nodes 312 are arranged such that, for each parking location $\text{PLocation}_m$, a specific one, or other small subset (e.g., two or three) of the vehicle response signal sensor nodes 312 covers that location.

Referring to FIG. 3, the illustrated example arrangement of vehicle signal sensor nodes 312 is one node per $\text{PLocation}_m$, with Q=M; in other words the vehicle signal sensors 312 and the repeaters 308 having a common arrangement.

With continuing reference to FIG. 3, an example of vehicle response signal nodes 312 is a node system in accordance with the wireless key sensor nodes 24 described in reference to the FIG. 1 architecture 10. Accordingly, an example output of the FIG. 3 vehicle response signal sensor may be a tuple-type data identifying a specific vehicle response signal, and identifying which of the signal sensor nodes 312 received the vehicle response signal.

Referring to FIG. 3, the example architecture 300 may include a network or array of, for example, R spatially separated vehicle response light-sound sensors, referenced collectively as vehicle light-sound nodes 314, and labeled individually as, for example, $\mathbf{314}_r$, where r=1 to R. In one embodiment, the vehicle light-sound nodes 314 may be arranged such that, for each parking location $\text{PLocation}_m$, only a specific and unique subset (e.g. one or two) of the vehicle light-sound nodes 314 covers that location.

Referring to FIG. 3, the illustrated example arrangement of vehicle light sound nodes 314 is one node per $\text{PLocation}_m$, with R=Q=M; in other words the vehicle light-sound nodes 314, signal sensor nodes 312 and the repeaters 308 having a common arrangement. It will be understood that the FIG. 3 illustrated relative arrangement of the vehicle light-sound nodes 314, signal sensor nodes 312 and the repeaters 308 is only an illustrative example for ease of understanding. Other arrangements of vehicle light-sound nodes 314, signal sensor nodes 312 and the repeaters 308 will be readily understood and identifiable by persons skilled in the relevant arts upon reading this description.

Referring to FIG. 3, an example implementation of the vehicle light-sound nodes 314 may be in accordance, at least functionally, with the light-sound sensor nodes 26, and associated multiple vehicle light-sound detector 30, described in reference to the FIG. 1 architecture 10. Accordingly, an example output of the FIG. 3 vehicle sound nodes 314 may be a tuple-type data, identifying a specific one, or a category of, vehicle response light pattern or sound, or both, and identifying the vehicle light-sound node 314 that received the identified light, or sound, or both.

With continuing reference to FIG. 3, an example architecture 300 may include a location processing algorithm 316 that may, for example, be included in or associated with the repeater controller 310, the vehicle signal nodes 312, and/or the vehicle light-sound nodes 314.

Referring to FIG. 3, one example location processing algorithm 316 may be constructed and arranged as a sequential trial scheme, wherein the repeater controller 310 sequentially increments through the repeaters 308 and the algorithm 316 senses the tuples from the vehicle light-sound nodes 314 and/or senses the tuples from the vehicle signal nodes 312 until a valid light, sound or signal response is detected. It will be obvious to persons skilled in the relevant arts, in view of this description, that this example sequential trial implementation of location processing algorithm 316 may reduce or avoid signal and frequency interference from sources other than the vehicle corresponding to the given wireless key signal repeated by the repeaters 308. This example sequential trial scheme is not limiting, however, as various other implementations of the location processing algorithm will be obvious to persons skilled in the relevant arts upon reading this entire description.

With continuing reference to FIG. 3, an example location processing algorithm 316 may be constructed and arranged to generate a vehicle location data such as, for example, a data labeled VLocation, based on the location of the repeater(s) 308 for which a valid response was detected from the vehicle 14, or the vehicle's lock, i.e., based on a tuple received from the repeater's associated vehicle signal sensor nodes 312 and/or vehicle light-sound sensor nodes 314.

Referring to FIG. 3, the vehicle location data, e.g. VLocation, may be displayed or otherwise communicated to a user 12 for example, the user interface 306.

As will be obvious to a person of ordinary skill in the relevant arts upon reading this description, an architecture according to 300 may detect a user's parked vehicle location substantially in real time and, accordingly, may provide a user the location of his or her parked vehicle simply by the user activating the vehicle's wireless key at, for example, a kiosk of a parking garage (the kiosk having a wireless key receiver 304), without any need for having previously detected, or stored a vehicle location information.

As will also be obvious to a person of ordinary skill in the relevant arts upon reading this entire description, an architecture according to 300 of FIG. 3 may provide a user with the location of his or vehicle regardless of a change in the protocol or format of signals exchanges between the wireless key and the vehicle lock, between the time the user locked his or her vehicle in the parking lot and the time of using the wireless key to obtain his or her vehicle location.

SPECIFIC EXAMPLE FLOWS

Figure 4:
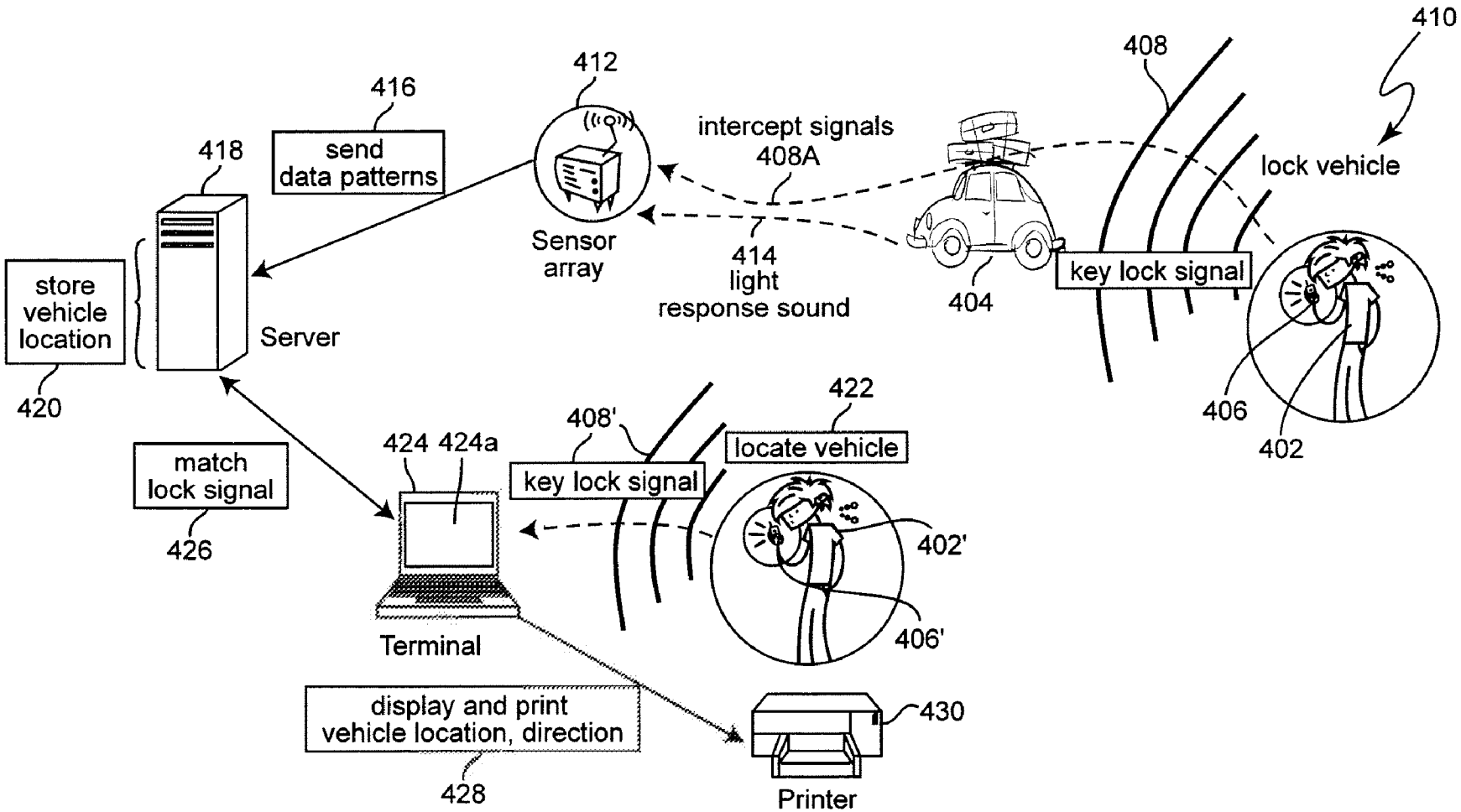
FIG. 4 illustrates an example functional flow of a vehicle location method on an embodiment in accord with FIG. 1.

FIG. 4 illustrates one example functional flow of a method carried out on, for example, the FIG. 1 architecture. The FIG. 4 example assumes that a user 402 has already parked his or her vehicle 404 at a location such as, for example, a parking location $PLocation_8$ in facility PK described in reference to FIG. 1. Further, FIG. 4 assumes that parking location $PLocation_8$ is covered by a wireless key signal receiver, such as key node $\mathbf{24}_8$ and by a vehicle sound node, such as sound node $\mathbf{26}_8$. The FIG. 4 example also assumes that the user's vehicle 404 has a wireless lock (not shown in FIG. 4) such as, for example, a conventional vehicle manufacture-supplied wireless lock as identified in reference to FIG. 1. The FIG. 4 example further assumes that the user's wireless key 406 generates a kind of signal detectable by the FIG. 1 multiple key signal detector 28, and that the vehicle's response light-sound (which may be only a sound, only a light, or both, as described in reference to FIG. 1) is detectable by the multiple vehicle response light-sound detector 32.

Referring to FIG. 4, at 410 the user 402 activates (e.g., presses) the given wireless key 406 to lock the vehicle 404 and, in response, the key 406 generates the wireless key signal 408. A portion 408A of the wireless key signal, i.e., an intercept portion, is received by key node $\mathbf{12}_8$ (not separately labeled in FIG. 4), which is within the FIG. 4 sensor array 412. Assuming a conventional type of vehicle wireless lock, the vehicle lock receives the wireless key signal 408, and responds by actuating the vehicle's locks (not shown) and by causing the vehicle 404 to emanate a response light and/or sound 414. The response light and/or sound 414 is (are) received by light-sound node $\mathbf{26}_8$ (not separately labeled in FIG. 4), within the FIG. 4 sensor array 412.

At 416 the sensor array 412 sends data patterns representing, for example, which of the respective nodes (i.e., key node $\mathbf{12}_8$ and light-sound node $\mathbf{26}_8$) within the sensor array 412 received the intercept signal 408A and the vehicle response light-sound 414. Assuming the sensor array 412 includes a multiple key code detector such as, for example, the multiple key code detector 28 described in reference to FIG. 1, and that the array 412 includes a multiple vehicle light-sound detector such as, for example, the multiple vehicle light-sound detector 30 of FIG. 1, and the data patterns at 416 may, for example, be tuples such as, for example, the tuples labeled as Key ID, Key Node ID, and Light-Sound ID, Light-Sound Node ID described in reference to FIG. 1.

With continuing reference to FIG. 4, at 420 the server 418 calculates and stores a location data, such as the data VPL described in reference to FIG. 1, to be retrievable based on the key-specific field of the intercept signal 408A generated by the key 406. The storage at 420 may include or embody, for example, a vehicle location storage 56 described in reference to FIG. 1. The location data VPL is based on a calculation at 420 of the spatial transmission origin of the wireless key signal 408, i.e., where the user 402 was standing when he or she locked the vehicle 404 at 410, and/or the spatial transmission origin of the vehicle response light-sound 414 (i.e. the vehicle 404 when emanating the light and/or sound comprising 414), and represents the parking location, in this case PLocation8, closest to that transmission origin.

Referring to FIG. 4, the calculation at 420 of the location data (e.g., VPL) may include a correlation between data in the 416 data patterns, in accordance with the input correlating algorithm 38 described in reference to FIG. 1, and a location processing in accordance with the location processing algorithm 40 described in reference to FIG. 1.

Referring to FIG. 4, at 422 a user 402' (which may or may not be the same person as user 402), while standing proximal (e.g., approximately one meter) to a user terminal 424, activates (e.g. presses) the same wireless key 406 that was used at 408 to lock the vehicle 404. For purposes of this FIG. 4 example, the phrase "the same wireless key 406" means the exact same physical key 406 that was used at 408, or a functional duplicate of that key 406. The wireless key 406 at 422 generates, in response, a wireless key signal labeled as 408'. As stated in the assumptions for this particular FIG. 4 example flow, it will be assumed that signal 408' has characteristics identical to 408, at least with respect to an identifier that is specific and unique to the wireless key 406.

With continuing reference to FIG. 2, the user terminal 424 includes a radio signal receiver (not separately labeled) such as, for example, the FIG. 1 signal receiver 54, the constructed and arranged to receive and, for example, digitize the wireless key signal 408'. An example user terminal 424 also includes, or is associated with, a terminal multiple key code detector 56 as described in reference to FIG. 1.

Referring to FIG. 4, the user terminal 424 (as well as the terminal key signal receiver 52 and terminal multiple key code detector 56 described in reference to FIG. 1) may be located at, for example, a kiosk (not shown) near a pedestrian entry (not shown) of the parking facility. Alternatively, the user terminal 424 may be located anywhere including, for example, an airport in a city remote from the user's vehicle 404, accessible by the user 402A.

Referring to FIG. 4, at 426, assuming the user terminal 424 includes a terminal key signal receiver 52 and terminal multiple key code detector 56 as described in reference to FIG. 1, the user terminal 424 detects a key-specific identifier of the received key signal 408', e.g., a data such the Terminal Key ID described in reference to FIG. 1, and uses that identifier to retrieve a location data from the server 418. The retrieved location data may be labeled, for example, as VPL described in reference to FIG. 1.

Assuming, as stated above, that the key-specific identifier, e.g. Terminal Key ID of 408' is that same as the key-specific identifier, e.g., Key ID used at 420 to store VPL, then the VPL retrieved at 426 is the VPL stored at 420, namely the location PLocation8 where the user 402, at 410, used key 406 to lock his or her vehicle 404.

Referring to FIG. 4, at 428 a video display, such as 424A of user terminal 424, or a printer 430, or another kind of user terminal interface 54 as described in reference to FIG. 1, presents the user 402' a visual representation (not shown) of the vehicle parking location VPL retrieved at 426. As described in reference FIG. 1, a user terminal interface 54 for performing 426 may include, without limitation, an interface to a user's personal digital assistant (PDA) (not shown).

Figure 5:
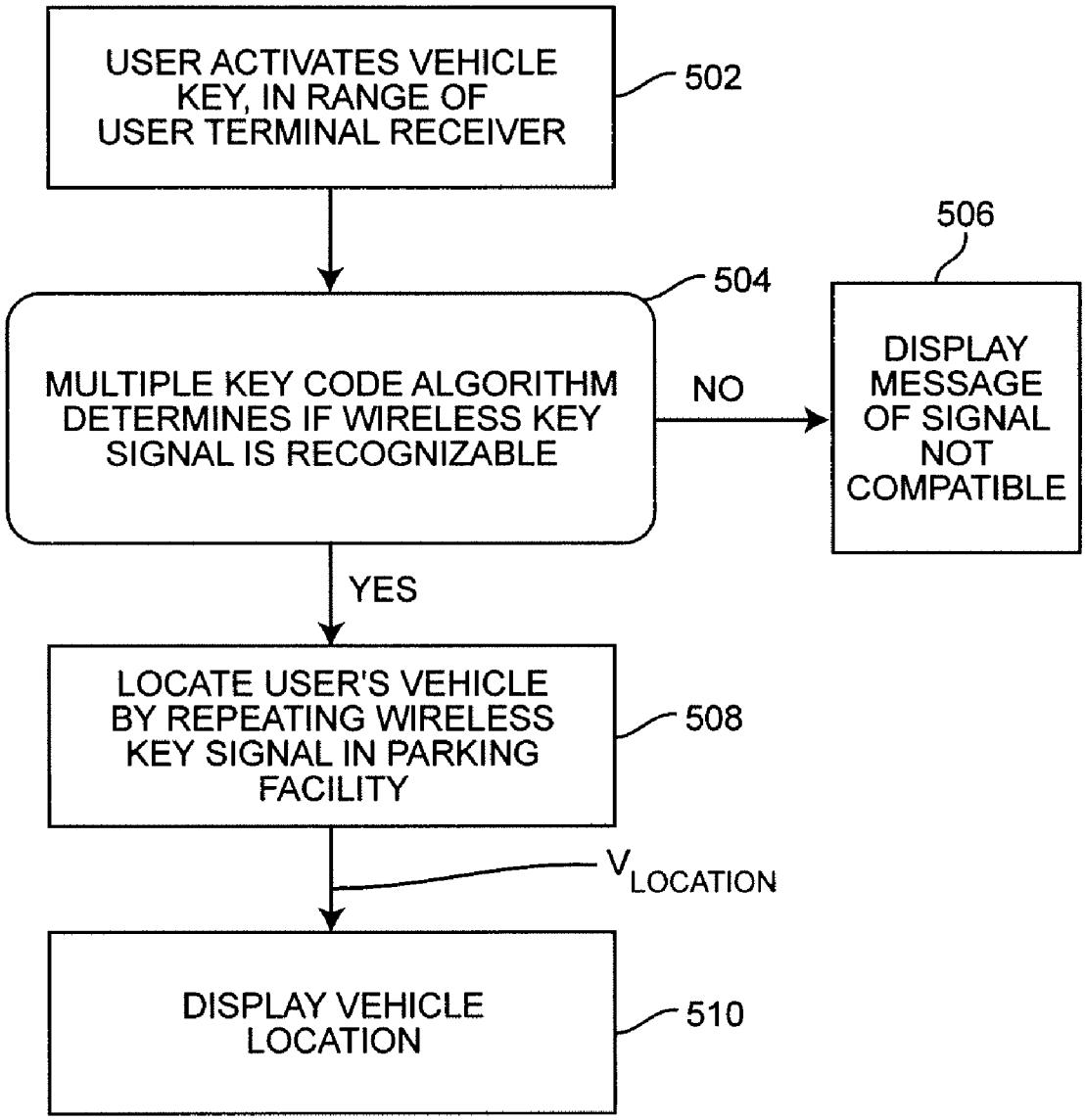
FIG. 5 illustrates an example functional flow of a vehicle location method on an embodiment in accord with FIG. 3.

FIG. 5 illustrates one example functional flow diagram of a method carried out on, for example, an implementation according to the FIG. 3 architecture 300.

Referring to FIG. 5, an example may start at 502 where a user walks or stands near (e.g., approximately one to four meters) a user terminal receiver such as the FIG. 3 example receiver 304 and activates (e.g. manually presses) his of her given wireless vehicle key. The user's vehicle, having a wireless lock corresponding to the given wireless key, is parked at, for example, a location remote from the terminal receiver used at 502. An example vehicle location is a parking space within a parking facility such as, for example, one of the parking locations labeled $PLocation_m$ (which may also be represented as "Row X, Space Y") within the facility PF described in reference to FIG. 3. An example location of the user terminal receiver (e.g., the FIG. 3 receiver 306) is at a kiosk (not shown) at a pedestrian entry (not shown) of the parking facility PF.

Referring to FIG. 5, a multiple key code detection 504, using a filter or detection algorithm such as, for example, the multiple key code detector 28 of the FIG. 3 example, determines if the wireless key signal transmitted by the user's key at 502 is compatible with the embodiment. An example criterion for compatibility, referring to FIG. 3, is whether or not the repeaters 308 can transmit the wireless key signal.

With continuing reference to FIG. 5, if the multiple key code detection 504 determines that the wireless key signal at 502 is not compatible then at 506 an appropriate message, or equivalent, may be displayed to the user through, for example, the example user interface 306 of FIG. 3.

Referring to FIG. 5, if the multiple key code detection 504 determines that the wireless key signal received at 502 is compatible with the embodiment, a locator sequence 508 proceeds to locate the user's vehicle in the parking facility. An example locator sequence 508 is in accordance with the example location processing algorithm 316 of FIG. 3, wherein a repeater controller, such as 310, sequentially increments through the repeaters 308 until detecting a valid tuple from the vehicle sound sensor nodes 314 or from the vehicle response signal sensor nodes 312. An example output of 508 is a vehicle location data such as, for example the FIG. 3 example VLocation, identifying the location of the repeater (s) 308 for which a valid response was detected from the vehicle or its wireless lock, i.e., a tuple was received from the repeater's associated vehicle signal sensor nodes 312 and/or vehicle light-sound sensor nodes 314.

Referring to FIG. 5, 510 displays the location, e.g., VLocation, at, for example, the FIG. 3 user interface 306.

While certain embodiments and features of the invention have been illustrated and described herein, many modifications, substitutions, changes, and equivalents will occur to those of ordinary skill in the art. It is therefore to be understood that the appended claims are intended to cover all such modifications and changes as fall within the spirit of the invention.

We hereby claim:

1. A method for locating a vehicle parking location in response to a wireless key signal having a key-specific identifier code, comprising:

receiving an instance of said wireless key signal;

generating a key code based on the key-specific identifier code in said received wireless key signal;

calculating a location from which said received instance of said wireless key signal was transmitted;

retrievably storing said location in a storage, said storing such that said location is retrievable based on said key code;

receiving another instance of the wireless key signal;

generating another key code based on the key-specific identifier code in said received another instance of the wireless key signal; and retrieving said location from said storage, based on said another key code.

2. The method of claim 1, further comprising:

receiving at least one of a vehicle light and a vehicle sound;

generating a vehicle characterizing data based on said received at least one of a vehicle light and a vehicle sound; and correlating said vehicle characterizing data with received wireless key signal, wherein said retrievably storing said location is contingent on said correlating.

3. The method of claim 2, wherein said generating a vehicle characterizing data includes providing a database having a given vehicle sound pattern data and, in response to receiving a vehicle sound at said receiving at least one of a vehicle light and a vehicle sound, detecting a match relation between said received vehicle sound and said given vehicle sound pattern data.

4. The method of claim 2, wherein said generating a vehicle characterizing data includes providing a database having a given vehicle light pattern data and, in response to receiving a vehicle light at said receiving at least one of a vehicle light and a vehicle sound, detecting a match relation between said received vehicle light and said given vehicle light pattern data.

5. The method of claim 4, wherein said receiving another instance of the wireless signal includes:

providing a terminal key signal receiver at a user location remote from all of said spatial areas;

transmitting the another instance of the wireless signal from location proximal to said user location; and receiving the transmitted another instance of the wireless signal at the terminal key signal receiver.

6. The method of claim 1, wherein said receiving an instance of the wireless signal includes:

providing a plurality of key signal receivers, arranged with respect to a given plurality of spatial areas, such that each of said receivers associated with a corresponding one of said spatial areas;

transmitting the instance of the wireless signal from a location within one of said spatial areas; and receiving the transmitted instance of the wireless signal at the key signal receiver associated with said one of said spatial areas.

7. A method for locating a vehicle parking location in response to a wireless key signal, comprising:

providing a plurality of key signal repeaters, arranged with respect to a given plurality of spatial areas, such that each of said repeaters is associated with a corresponding at least one of said spatial areas;

receiving said wireless key signal;

transmitting repeats of said received wireless key signal from said key signal repeaters;

detecting an instance of at least one of a response signal and a response sound;

associating said detected instance with at least one of said key signal repeaters; and generating a vehicle parking location data based on said associating.

8. The method of claim 7, wherein said transmitting repeats includes transmitting a sequence of said repeats, each of said sequence being from a corresponding one of said repeaters.

9. A system for locating a vehicle parking location in response to a wireless key signal, comprising:

a computer-readable storage medium encoded with instructions capable of being executed by a computer, the instructions including:

instructions for receiving an instance of said wireless key signal;

instructions for generating a key code based on the key-specific identifier code in said received wireless key signal;

instructions for calculating a location from which said received instance of said wireless key signal was transmitted;

instructions for retrievably storing said location in a storage, said storing such that said location is retrievable based on said key code;

instructions for receiving another instance of the wireless key signal;

instructions for generating another key code based on the key-specific identifier code in said received another instance of the wireless key signal; and instructions for retrieving said location from said storage, based on said another key code.

10. The system of claim 9, wherein said instructions further include:

instructions for receiving at least one of a vehicle light and a vehicle sound;

instructions for generating a vehicle characterizing data based on said received at least one of a vehicle light and a vehicle sound; and instructions for correlating said vehicle characterizing data with received wireless key signal, wherein said instructions for retrievably storing said location instruct sand retrievable storing as contingent on said correlating.

11. The system of claim 10, wherein said instructions for generating a vehicle characterizing data include instructions for providing a database having a given vehicle sound pattern data and instructions for detecting, in response to receiving a vehicle sound at said receiving at least one of a vehicle light and a vehicle sound, a match relation between said received vehicle sound and said given vehicle sound pattern data.

12. The system of claim 9, wherein said instructions for generating a vehicle characterizing data include instructions for providing a database having a given vehicle light pattern data and instructions for detecting, in response to receiving a vehicle light at said receiving at least one of a vehicle light and a vehicle sound, a match relation between said received vehicle light and said given vehicle light pattern data.

13. A system for locating a vehicle parking location, comprising:

a plurality of key signal repeaters, arranged with respect to a given plurality of spatial areas, such that each of said repeaters is associated with a corresponding at least one of said spatial areas;

a computer-readable storage medium encoded with instructions capable of being executed by a computer, the instructions including:

instructions for receiving said wireless key signal;

instructions for transmitting repeats of said received wireless key signal from said key signal repeaters;

instructions for detecting an instance of at least one of a response signal and a response sound;

instructions for associating said detected instance with at least one of said key signal repeaters; and instructions for generating a vehicle parking location data based on said associating.

14. The system of claim 13, wherein said instructions for transmitting repeats include instructions transmitting a sequence of said repeats, each of said sequence being from a corresponding one of said repeaters.

* * * * *